US011028562B2

(12) United States Patent
Yeh

(10) Patent No.: US 11,028,562 B2
(45) Date of Patent: Jun. 8, 2021

(54) FAUCET

(71) Applicant: Ta-Yu Yeh, Changhua (TW)

(72) Inventor: Ta-Yu Yeh, Changhua (TW)

( * ) Notice: Subject to any disclaimer, the term of this patent is extended or adjusted under 35 U.S.C. 154(b) by 75 days.

(21) Appl. No.: 16/683,134

(22) Filed: Nov. 13, 2019

(65) Prior Publication Data

US 2021/0140153 A1 May 13, 2021

(51) Int. Cl.
*E03C 1/04* (2006.01)

(52) U.S. Cl.
CPC ..... *E03C 1/04* (2013.01)

(58) Field of Classification Search
CPC ..... E03C 1/04; E03C 1/0404
USPC ..... 4/678
See application file for complete search history.

(56) References Cited

U.S. PATENT DOCUMENTS 7,770,808 B2 * 8/2010 Ruga ..... G05D 23/1353 236/12.2
8,763,624 B1 * 7/2014 Huang ..... E03C 1/0404 137/119.05
9,255,388 B2 * 2/2016 Huang ..... E03C 1/0404

* cited by examiner

*Primary Examiner* — Lauren A Crane
(74) *Attorney, Agent, or Firm* — Che-Yang Chen; Law Office of Michael Chen

(57) ABSTRACT

A faucet may include a shell, a control sleeve, a connecting sleeve, a water-stop unit, a locating unit, and a locking tube. The shell has an axial connecting hole, and the control sleeve secured with the connecting hole has an axle hole. The connecting sleeve comprises a tube portion having an axial rod hole formed at a central portion thereof. The water-stop unit comprises a front rod, a water-stop plug, and a rear rod, and the front rod penetrates through the axle hole and the rod hole to locate the water-stop plug in the connecting sleeve. The front rod is engaged with a nut at a front end after penetrating through the axle hole. A first spring and a second spring, which are disposed on the front rod, are respectively coupled between the nut and the control sleeve and between the water-stop plug and the connecting sleeve.

4 Claims, 7 Drawing Sheets

FAUCET

FIELD OF THE INVENTION

The present invention relates to a faucet and more particularly to a faucet control structure that can switch and keep water flow out from a faucet or a shower head without leaking.

BACKGROUND OF THE INVENTION

Referring to FIG. 7, a conventional faucet comprises a shell (70), a pipe (80), and a switch unit (90). The shell (70) has a connecting space (71) formed therein, and two ends of the connecting space (71) respectively have a connecting end (72) and a water outlet hole (73). Moreover, an axle hole (74) is formed at a top wall of the water outlet hole (73). The pipe (80) is a hollow cylindrical tube body comprising a water channel (81) formed therein, and a neck portion (82), which is formed integrally with the water channel (81), protrudes from a front end of the pipe (80), and a rear end of the pipe (80) is cooperated with the connecting end (72) to connect to a locating board (83). The locating board (83) has a pipe hole (831) which is communicated with the water channel (81) and connected to a water source. The switch unit (90) has a rod frame (91), a rod base (92), a valve rod (93), a valve block (94), a compression spring (95), a pull button (96), and a gasket (97). A fin portion (912) is formed at an outer periphery of the rod frame (91) and is coupled in the water channel (81) of the pipe (80), and the rod frame (91) comprises a first rod hole (911) which is located at a position corresponding to the axle hole (74). The rod base (92) is a tube body which is inserted and secured into the axle hole (74) of the shell (70), and the rod base (92) has a second rod hole (921) formed at a position corresponding to the axle hole (74). The valve rod (93) slidably penetrates through the first rod hole (911) and the second rod hole (921), and an abutting board (931) is secured on an outer periphery of the valve rod (93). Moreover, the valve rod (93) is cooperated with a C-shaped ring (932) to secure the valve block (94) on the valve rod (93). The compression spring (95) is disposed on the valve rod (93), and two ends of the compression spring (95) are respectively abutted against the rod base (92) and the valve block (94). An end of the valve rod (93) penetrating through the rod base (92) comprises a thread portion (933) to lock the pull button (96) thereon, and the pull button (96) is adapted to drive and control the switch unit (90). The gasket (97) is disposed on the valve rod (93) between the rod base (92) and the compression spring (95). A user can pull the pull button (96) protruding out of the shell (70) to drive the valve rod (93) so as to switch water flow to a faucet or a shower head.

However, the conventional faucet has following disadvantages: (i) the structure that the rod base (92) is inserted and secured into the axle hole (74) of the shell (70) and one end of the compression spring (95) is directly abutting against the rod base (92) may cause that the compression spring (95) cannot be firmly abutted against the rod base (92) and provide sufficient resilience, such that the water pressure is prone to push the valve block (94), leading to switching water flow from the faucet to the shower head; and (ii) when the pull button (96) protruding from a front end of the shell (70) is at a position that water flows out from the shower head, it is easily pushed by accident to switch water flow to the faucet. Therefore, there remains a need for a new and improved design for a faucet to overcome the problems presented above.

SUMMARY OF THE INVENTION

The present invention provides a faucet which comprises a shell, a control sleeve, a connecting sleeve, a water-stop unit, a locating unit, and a locking tube. The shell has a partition therein, and a connecting hole axially penetrates through the partition. The control sleeve secured at the position of the connecting hole comprises an axle hole at one end, and at least a first flow hole is formed around the axle hole. The connecting sleeve has a tube portion at one end, and an inner thread section is formed at the other end of the connecting sleeve, and at least an O-ring is disposed on the tube portion. The connecting sleeve is inserted into the control sleeve through the tube portion, and the O-ring is abutted against an inner periphery of the control sleeve to achieve the leakproof effect. The tube portion comprises an axial rod hole formed at a central portion thereof, and a plurality of second flow holes are formed around the rod hole. The connecting sleeve has a water-stop ring formed between the rod hole and the inner thread section. The water-stop unit comprises a front rod, a water-stop plug, and a rear rod formed sequentially, and the front rod of the water-stop unit is adapted to penetrate through the axle hole and the rod hole so as to locate the water-stop plug in the connecting sleeve. The front rod is engaged with a nut at a front end after penetrating through the axle hole. A first spring and a second spring, which are disposed on the front rod, are respectively coupled between the nut and the control sleeve and between the water-stop plug and the connecting sleeve. The locating unit has an axial sliding hole at a central portion thereof, and the locating unit is disposed on the rear rod through the sliding hole, and a plurality of supporting legs protrude from an outer periphery of the locating unit. The locking tube is engaged with the inner thread section of the connecting sleeve, and the supporting legs of the locating unit is secured between the locking tube and the connecting sleeve.

In one embodiment, at least a locating portion protrudes from the other end of the control sleeve, and at least a recess is formed on an outer periphery of the connecting sleeve, and the locating portion is coupled in the recess to secure the position of the control sleeve and the connecting sleeve.

In another embodiment, the control sleeve has an outer thread section which is engaged with the connecting hole.

In still another embodiment, the first spring and the second spring have the same elastic force, and the nut is adapted to be locked to increase the resilience of the first spring.

Comparing with conventional faucet, the present invention is advantageous because: (i) When water is turned off, the water pressure on the water-stop plug is disappeared, and the first spring and the second spring are adapted to push the water-stop unit back to its initial position, and water is adapted to come out from the faucet when used next time so as to prevent the user from getting wet in case that water suddenly comes out from the shower head; (ii) the first spring and the second spring are configured to form reciprocal spring forces, such that when one end of the locking tube is locked on the connecting sleeve and the other end thereof is connected to a water outlet tube on a wall, the control sleeve abutted by the first spring is adapted to be moved toward the rear direction, and the shell secured with the control sleeve is driven and abutted against the wall, thereby achieving the automatic adjustment of assembly position for the shell; and (iii) the user can pull the shell to switch water flow from the faucet or the shower head, and the first spring and the second spring are configured to cooperately move the shell back to its initial position when the shell is released so as to prevent the situation of switching water flow due to accidental touch, thereby enhancing the practicality of the faucet.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
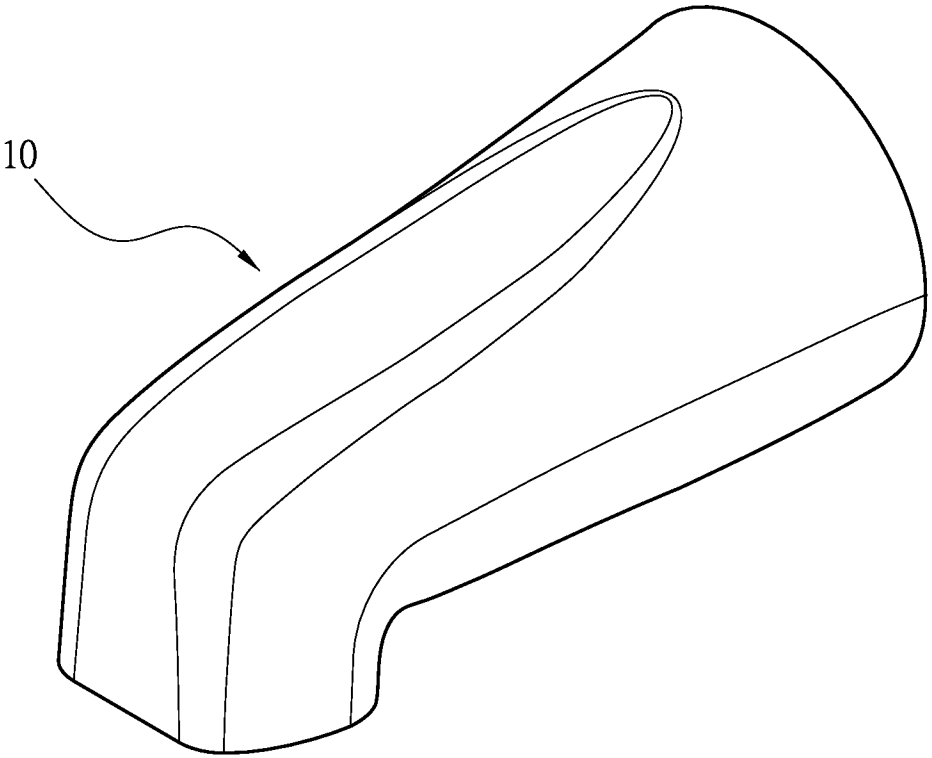
FIG. 1 is a three-dimensional assembly view of a faucet of the present invention.
Figure 2:
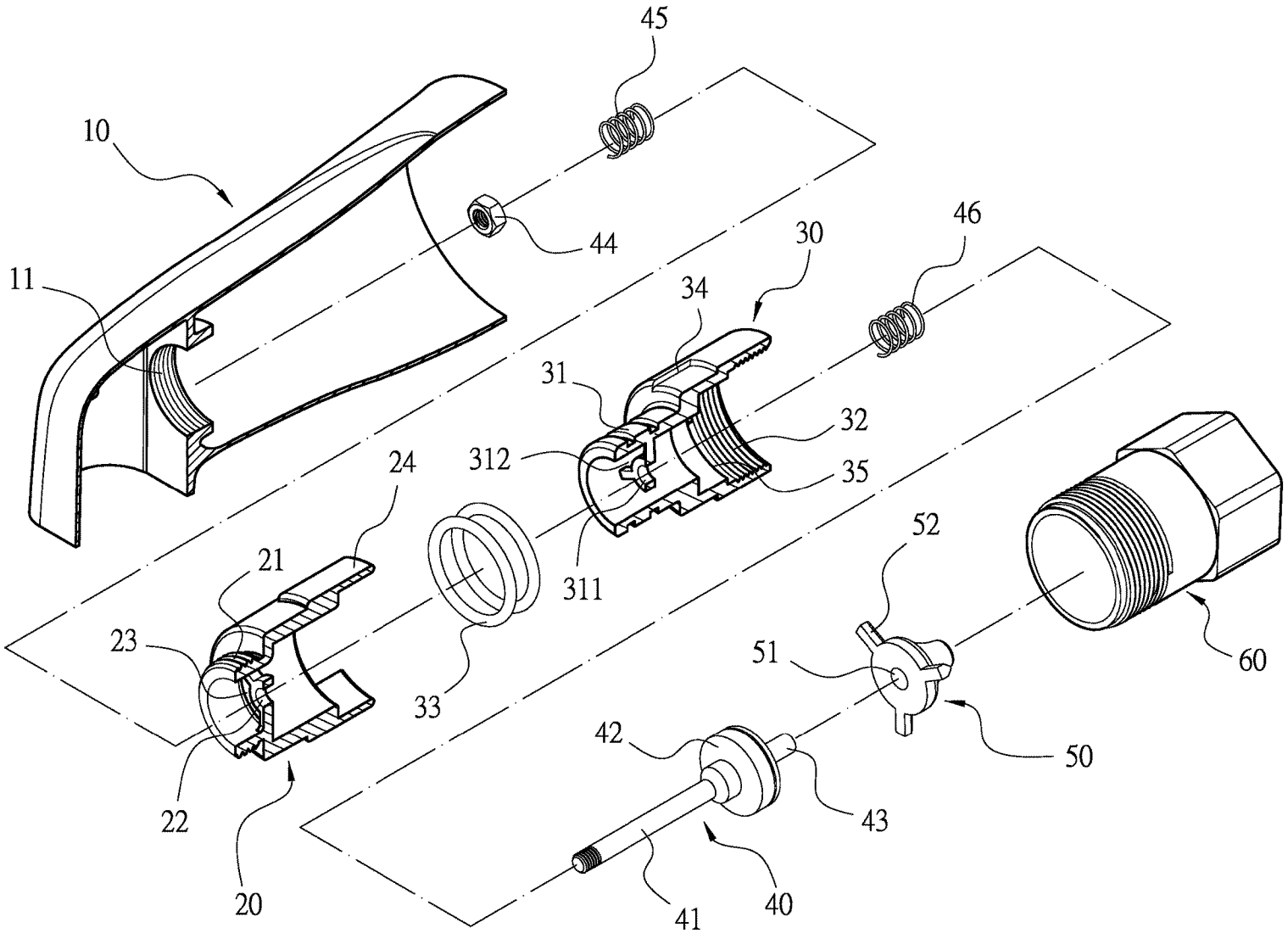
FIG. 2 is a three-dimensional exploded view of the faucet of the present invention.
Figure 3:
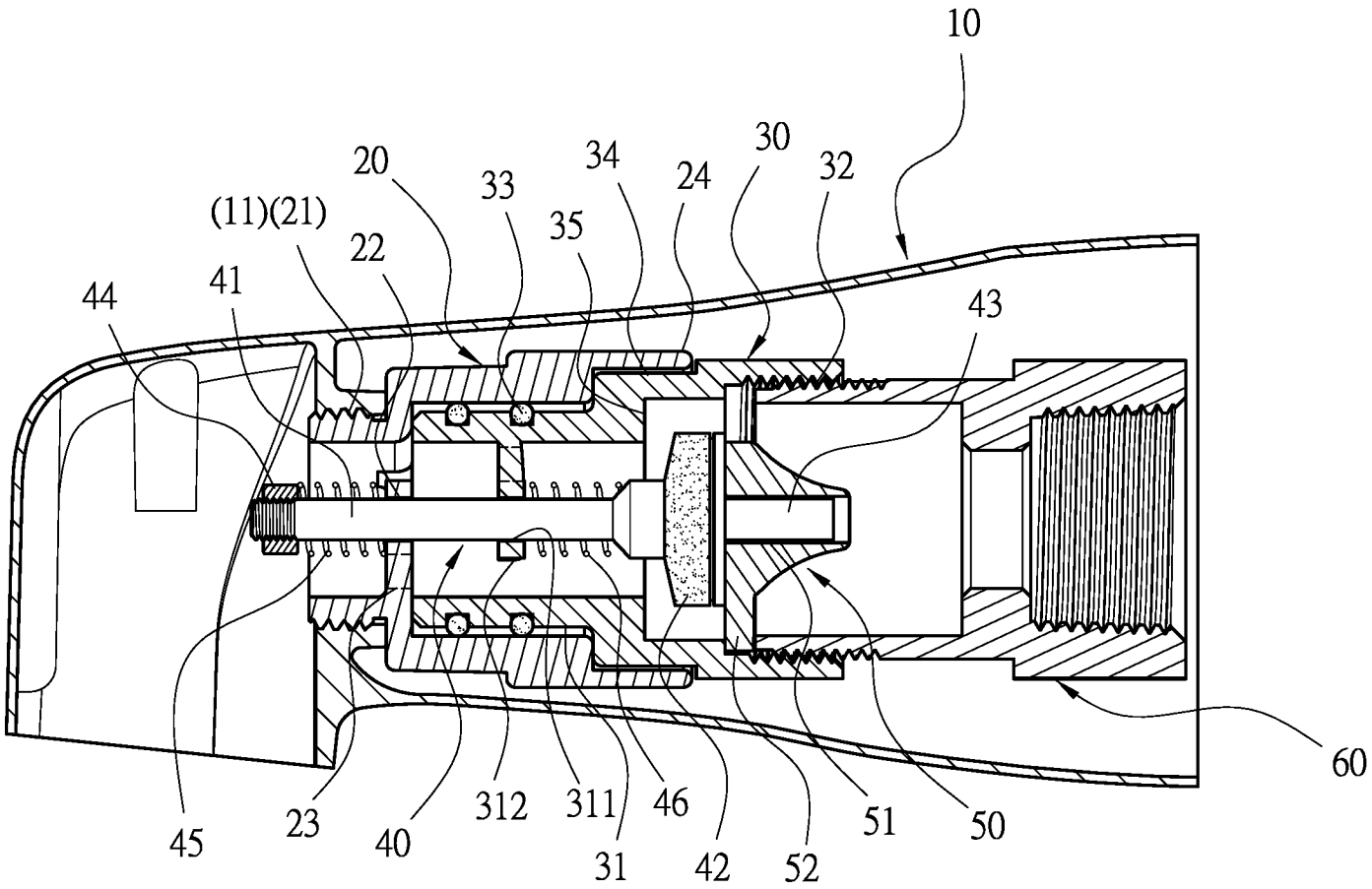
FIG. 3 is a sectional view of the faucet of the present invention.

In order to further understand the goal, characteristics and effect of the present invention, a number of embodiments along with the drawings are illustrated as following:

Referring to FIGS. 1 to 3, the present invention provides a faucet which comprises a shell (10), a control sleeve (20), a connecting sleeve (30), a water-stop unit (40), a locating unit (50), and a locking tube (60). The shell (10) has a partition therein, and a connecting hole (11) axially penetrates through the partition. The control sleeve (20) has an outer thread section (21) which is engaged with the connecting hole (11) to secure the control sleeve (20) with the shell (10). The control sleeve (20) comprises an axle hole (22) at one end, and at least a first flow hole (23) is formed around the axle hole (22), and at least a locating portion (24) protrudes from the other end of the control sleeve (20). The connecting sleeve (30) has a tube portion (31) at one end, and an inner thread section (32) is formed at the other end of the connecting sleeve (30), and at least an O-ring (33) is disposed on the tube portion (31). The connecting sleeve (30) is inserted into the control sleeve (20) through the tube portion (31), and the O-ring (33) is abutted against an inner periphery of the control sleeve (20) to achieve the leakproof effect. Moreover, at least a recess (34) is formed on an outer periphery of the connecting sleeve (30), and the locating portion (24) is coupled in the recess (34) to secure the position of the control sleeve (20) and the connecting sleeve (30). The tube portion (31) comprises an axial rod hole (311) formed at a central portion thereof, and a plurality of second flow holes (312) are formed around the rod hole (311). Furthermore, the connecting sleeve (30) has a water-stop ring (35) formed between the rod hole (311) and the inner thread section (32). The water-stop unit (40) comprises a front rod (41), a water-stop plug (42), and a rear rod (43) formed sequentially, and the front rod (41) of the water-stop unit (40) is adapted to penetrate through the axle hole (22) and the rod hole (311) so as to locate the water-stop plug (42) in the connecting sleeve (30). In addition, the front rod (41) is engaged with a nut (44) at a front end after penetrating through the axle hole (22). Also, a first spring (45) and a second spring (46), which are disposed on the front rod (41), are respectively coupled between the nut (44) and the control sleeve (20) and between the water-stop plug (42) and the connecting sleeve (30). Furthermore, the first spring (45) and the second spring (46) have the same elastic force, and the nut (44) is adapted to be locked so as to increase the resilience of the first spring (45). The locating unit (50) has an axial sliding hole (51) at a central portion thereof, and the locating unit (50) is disposed on the rear rod (43) through the sliding hole (51), and a plurality of supporting legs (52) protrude from an outer periphery of the locating unit (50). The locking tube (60) is engaged with the inner thread section (32) of the connecting sleeve (30), and the supporting legs (52) of the locating unit (50) is secured between the locking tube (60) and the connecting sleeve (30).

Structurally, referring to FIGS. 2 and 3, the second spring (46) is disposed on the front rod (41) of the water-stop unit (40), and the front rod (41) penetrates through the connecting sleeve (30) from the end having the inner thread section (32), and the front rod (41) penetrates through the rod hole (311) of the tube portion (31). The water-stop plug (42) is positioned in the connecting sleeve (30), and the second spring (46) is coupled between the connecting sleeve (30) and the water-stop plug (42). The O-ring (33) is disposed on the tube portion (31), and a front end of the tube portion (31) is inserted into the control sleeve (20). Moreover, the O-ring (33) is abutted against the inner periphery of the control sleeve (20), and the locating portion (24) is slidably coupled in the recess (34) of the connecting sleeve (30). The front rod (41) is configured to penetrate through the axle hole (22) of the control sleeve (20), and the first spring (45) is disposed on the front rod (41). Then, the nut (44) is locked on the front rod (41) so as to couple the first spring (45) between the nut (44) and control sleeve (20). The locating unit (50) is coupled in the connecting sleeve (30) at the end having the inner thread section (32), and the sliding hole (51) is disposed on the rear rod (43) of the water-stop unit (40). The locking tube (60) is engaged with the inner thread section (32) of the connecting sleeve (30), and the supporting legs (52) are secured between the locking tube (60) and the connecting sleeve (30). After the control sleeve (20), the connecting sleeve (30), the water-stop unit (40), the locating unit (50), and the locking tube (60) are assembled together, the shell (10) is coupled therearound, and the connecting hole (11) is engaged with the outer thread section (21) of the control sleeve (20), thereby completing the assembly.

Figure 4:
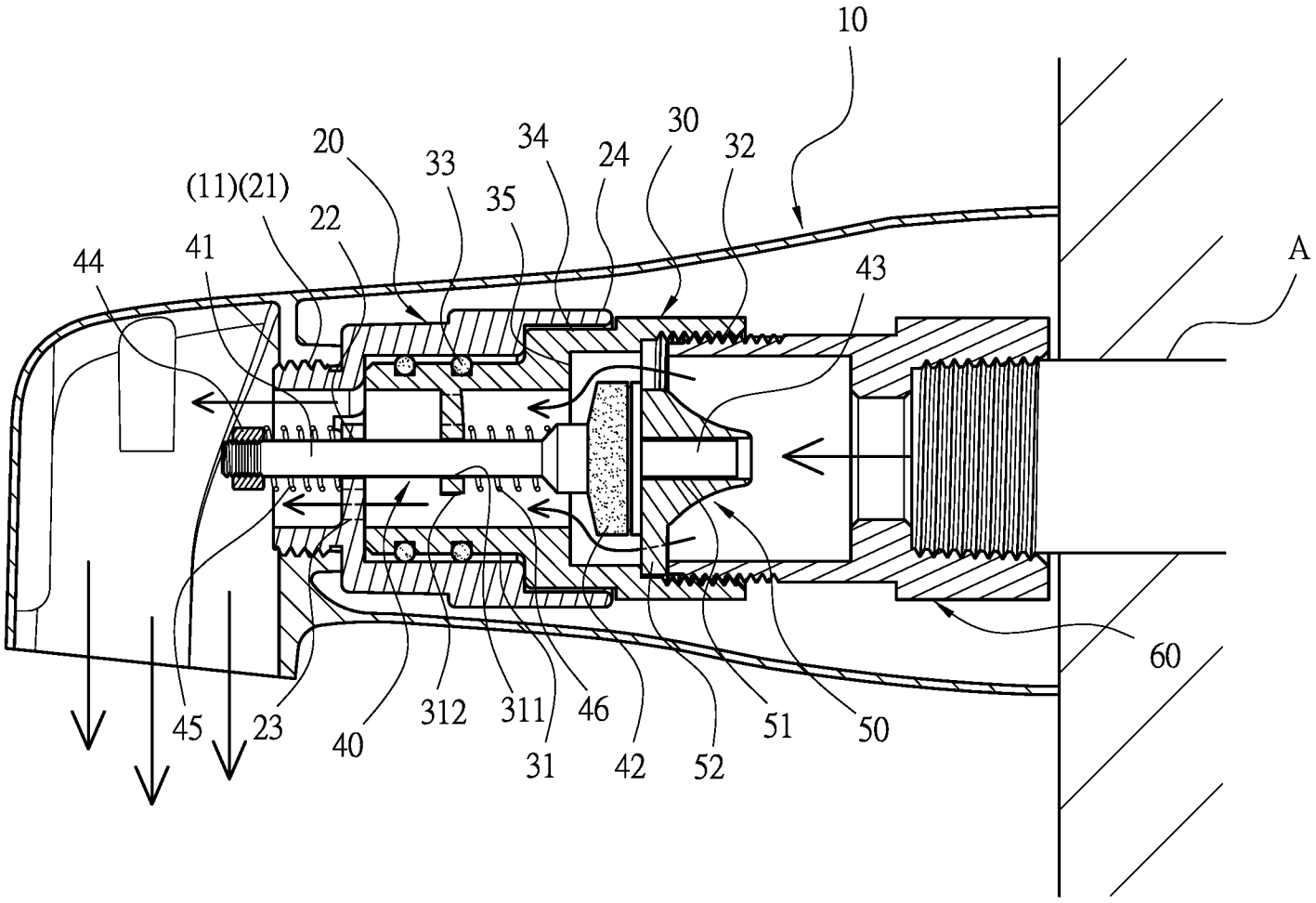
FIG. 4 is a first schematic view illustrating the faucet of the present invention is in use.
Figure 5:
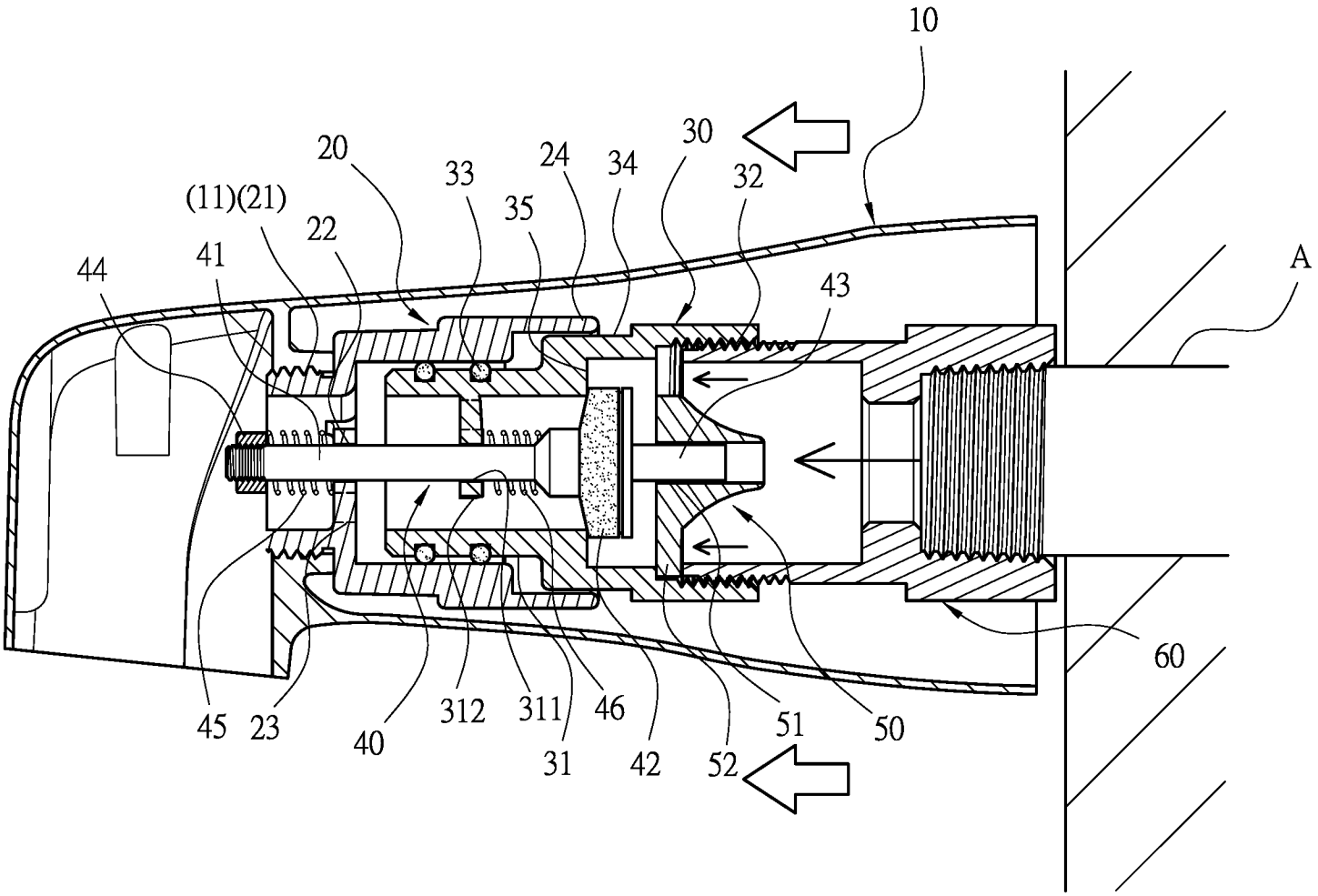
FIG. 5 is a second schematic view illustrating the faucet of the present invention is in use.
Figure 6:
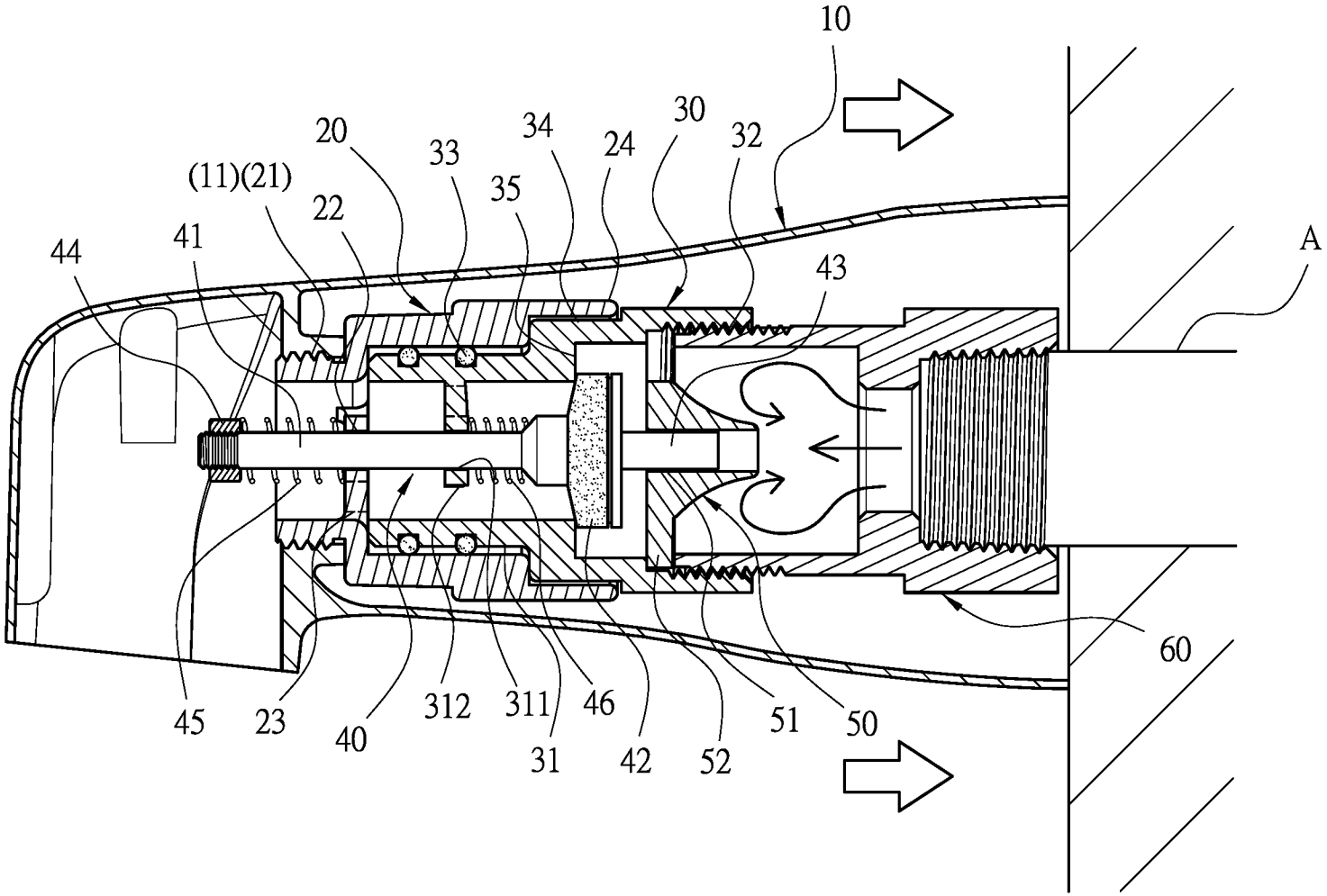
FIG. 6 is a third schematic view illustrating the faucet of the present invention is in use.
Figure 7:
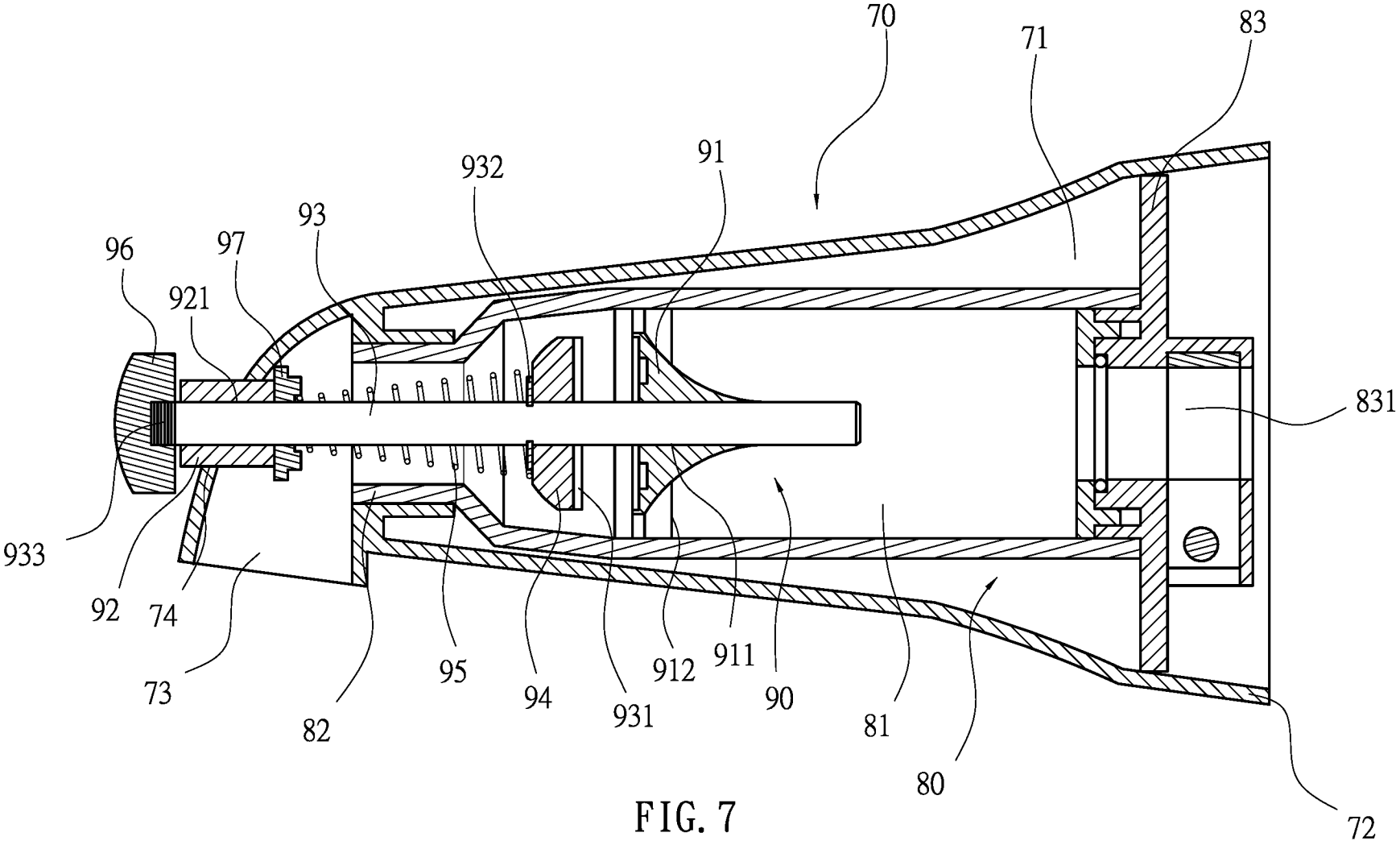
FIG. 7 PRIOR ART
FIG. 7 is a prior art.

In actual application, referring to FIGS. 2 to 4, the control sleeve (20) is sleeved on the tube portion (31) of the connecting sleeve (30), such that the control sleeve (20) and the connecting sleeve (30) are slidable to change the relative position. The front rod (41) of the water-stop unit (40) penetrates through the axle hole (22) of the control sleeve (20), and the first spring (45) and the nut (44) are disposed on the front rod (41) to limit the position of the control sleeve (20) while the second spring (46) and the water-stop plug (42) are adapted to limit the position of the connecting sleeve (30) so as to enable the control sleeve (20) and the connecting sleeve (30) to be not detached from each other. Moreover, the first spring (45) and the second spring (46) are configured to form reciprocal spring forces, such that when one end of the locking tube (60) is locked on the connecting sleeve (30) and the other end thereof is connected to a water outlet tube (A) on a wall, the control sleeve (20) abutted by the first spring (45) is adapted to be moved toward the rear direction, and the shell (10) secured with the control sleeve (20) is driven and abutted against the wall, thereby achieving the automatic adjustment of assembly position for the shell (10).

Furthermore, referring to FIGS. 2 to 6, before used, the end at the locking tube (60) has no water pressure, and the first spring (45) and the second spring (46) providing the reciprocal spring forces are adapted to keep the water-stop unit (40) in the conducting position that the water-stop plug (42) is not abutted against the water-stop ring (35) of the connecting sleeve (30). Thus, water is configured to flow from the water outlet tube (A) through the second flow holes (312) of the connecting sleeve (30) and the first flow hole (23) of the control sleeve (20), and flow out of the faucet only from a front end of the shell (10), thereby preventing water coming out from a shower head incautiously. When water needs to come out from the shower head, a user only need to pull the shell (10) in the direction away from the connecting sleeve (30), and the shell (10) is configured to drive the control sleeve (20) to press the first spring (45), and the water-stop plug (42) of the water-stop unit (40) is driven to move toward the water-stop ring (35) of the connecting sleeve (30) so as to stop water flowing from the front end of the shell (10) and enable the water pressure to press on the water-stop plug (42). When the user releases the shell (30), the first spring (45) is adapted to pull the shell (10) back to its initial position, and the elastic force of the first spring (45) together with the water pressures is provided to withstand the elastic force of the second spring (46) so as to keep the water-stop plug (42) at the water-stop position and to enable water to flow out from the shower head. When water is turned off, the water pressure on the water-stop plug (42) is disappeared, and the first spring (45) and the second spring (46) are adapted to push the water-stop unit (40) back to its initial position, and water is adapted to come out from the faucet when used next time so as to prevent the user from getting wet in case that water suddenly comes out from the shower head. Notably, the movements of the water-stop unit (40) and the shell (10) are achieved through the cooperation of the first spring (45) and the second spring (46), which effectively improves the use stability and durability of the faucet. More specifically, the user can pull the shell (10) to switch water flow from the faucet or the shower head, and the first spring (45) and the second spring (46) are configured to cooperately move the shell (10) back to its initial position when the shell (10) is released so as to prevent the situation of switching water flow due to accidental touch, thereby enhancing the practicality of the faucet.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A faucet comprising a shell, a control sleeve, a connecting sleeve, a water-stop unit, a locating unit, and a locking tube;

wherein the shell has a partition therein, and a connecting hole axially penetrates through the partition;

wherein the control sleeve secured at the position of the connecting hole comprises an axle hole at one end, and at least a first flow hole is formed around the axle hole;

wherein the connecting sleeve has a tube portion at one end, and an inner thread section is formed at the other end of the connecting sleeve, and at least an O-ring is disposed on the tube portion; the connecting sleeve is inserted into the control sleeve through the tube portion, and the O-ring is abutted against an inner periphery of the control sleeve to achieve the leakproof effect; the tube portion comprises an axial rod hole formed at a central portion thereof, and a plurality of second flow holes are formed around the rod hole; the connecting sleeve has a water-stop ring formed between the rod hole and the inner thread section;

wherein the water-stop unit comprises a front rod, a water-stop plug, and a rear rod formed sequentially, and the front rod of the water-stop unit is adapted to penetrate through the axle hole and the rod hole so as to locate the water-stop plug in the connecting sleeve; the front rod is engaged with a nut at a front end after penetrating through the axle hole; a first spring and a second spring, which are disposed on the front rod, are respectively coupled between the nut and the control sleeve and between the water-stop plug and the connecting sleeve;

wherein the locating unit having an axial sliding hole at a central portion thereof is disposed on the rear rod through the sliding hole, and a plurality of supporting legs protrude from an outer periphery of the locating unit; and wherein the locking tube is engaged with the inner thread section of the connecting sleeve, and the supporting legs of the locating unit is secured between the locking tube and the connecting sleeve.

2. The faucet of claim 1, wherein at least a locating portion protrudes from the other end of the control sleeve, and at least a recess is formed on an outer periphery of the connecting sleeve, and the locating portion is coupled in the recess to secure the position of the control sleeve and the connecting sleeve.

3. The faucet of claim 1, wherein the control sleeve has an outer thread section which is engaged with the connecting hole.

4. The faucet of claim 1, wherein the first spring and the second spring have the same elastic force, and the nut is adapted to be locked to increase the resilience of the first spring.

* * * * *